US011289041B2

(12) United States Patent
Huang

(10) Patent No.: US 11,289,041 B2
(45) Date of Patent: Mar. 29, 2022

(54) DISPLAY DEVICE AND DRIVING METHOD THEREOF

(71) Applicant: HKC CORPORATION LIMITED, Guangdong (CN)

(72) Inventor: Beizhou Huang, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 135 days.

(21) Appl. No.: 16/647,957

(22) PCT Filed: Dec. 13, 2017

(86) PCT No.: PCT/CN2017/115782
§ 371 (c)(1),
(2) Date: Mar. 17, 2020

(87) PCT Pub. No.: WO2019/052041
PCT Pub. Date: Mar. 21, 2019

(65) Prior Publication Data

US 2020/0294459 A1 Sep. 17, 2020

(30) Foreign Application Priority Data

Sep. 18, 2017 (CN) ..... 201710839781.7

(51) Int. Cl.
*G09G 3/36* (2006.01)

(52) U.S. Cl.
CPC ... *G09G 3/3648* (2013.01); *G09G 2320/0626* (2013.01)

(58) Field of Classification Search
None
See application file for complete search history.

(56) References Cited

U.S. PATENT DOCUMENTS 6,351,077 B1 * 2/2002 Koyama ..... G09G 3/3275 315/169.3
2002/0149607 A1 * 10/2002 Ito ..... G09G 3/3696 345/690

(Continued)

FOREIGN PATENT DOCUMENTS

CN 1822086 A 8/2006
CN 105825830 A 8/2016

(Continued)

*Primary Examiner* — Parul H Gupta
(74) *Attorney, Agent, or Firm* — Muncy, Geissler, Olds & Lowe, P.C.

(57) ABSTRACT

The present disclosure provides a driving method of a display device and a display device. The driving method comprising: acquiring a pre-display image, wherein each of sub-pixels in the pre-display image corresponds to a predetermined grayscale voltage; displaying the same pre-display image in continuous m frame display cycles, wherein in at least one frame display cycle of the m frame display cycles, a drive voltage of a blue sub-pixel on a display panel of the display device is higher than the predetermined grayscale voltage corresponding to the blue sub-pixel; in at least one frame display cycle of the m frame display cycles, the drive voltage of the blue sub-pixel at a same position on the display panel is lower than the predetermined grayscale voltage corresponding to the blue sub-pixel.

12 Claims, 5 Drawing Sheets

(56) References Cited

U.S. PATENT DOCUMENTS

| | | | | |
|---|---|---|---|---|
| 2004/0257323 | A1* | 12/2004 | Heo | G09G 3/3413 345/88 |
| 2006/0192747 | A1* | 8/2006 | Yoon | G09G 3/3648 345/102 |
| 2006/0208656 | A1* | 9/2006 | Hara | G09G 3/2014 315/169.3 |
| 2008/0185589 | A1* | 8/2008 | Shin | G02F 1/136213 257/59 |
| 2014/0232624 | A1* | 8/2014 | Kim | G09G 3/3614 345/87 |
| 2016/0189670 | A1* | 6/2016 | Kim | G09G 5/02 345/690 |
| 2017/0154587 | A1* | 6/2017 | Chen | G09G 3/3607 |
| 2017/0193929 | A1* | 7/2017 | Chen | G09G 3/3607 |

FOREIGN PATENT DOCUMENTS

| | | | |
|---|---|---|---|
| CN | 106054478 | A | 10/2016 |
| CN | 106504717 | A | 3/2017 |
| CN | 106531106 | A | 3/2017 |

* cited by examiner

DISPLAY DEVICE AND DRIVING METHOD THEREOF

BACKGROUND OF THE INVENTION

Field of Invention

This disclosure relates to a technical field of a display, and more particularly to a display device and a driving method of the display device.

Related Art

Most of conventional large-size liquid crystal display devices adopt the vertical alignment (VA) type liquid crystal with the negative dielectric constant or the in-plane switching (IPS) liquid crystal. In the condition of the large viewing angle, the brightness of the pixel in the VA type liquid crystal display device rapidly gets saturated with the drive voltage, thereby causing the liquid crystal display device to have the more serious color shift phenomenon in the condition of the large viewing angle, and thus affecting the display quality of the liquid crystal display device.

The liquid crystal display device adopting the polarity inversion technology can improve the color shift problem in the condition of the large viewing angle. At present, the method of solving the large view-angle color shift problem of the liquid crystal display device is to divide each sub-pixel in the liquid crystal display panel into a primary pixel and a secondary pixel, and provide drive voltages with different polarities to the primary pixel and the secondary pixel of each sub-pixel, so that the primary and secondary pixels of each sub-pixel corresponding to the liquid crystal molecules have different deflection directions to enhance the optical isotropy effect of the liquid crystal molecule and to solve the color shift problem of the liquid crystal display panel in the condition of the large viewing angle.

However, providing different drive voltages to the primary pixel and the secondary pixel of each sub-pixel needs to add metal traces and thin film transistor elements to respectively drive the primary and secondary pixels, and these metal traces and thin film transistor elements reduce the light-permeable area of the liquid crystal display panel, thereby affecting the through rate of the liquid crystal display panel and increasing the backlight cost of the liquid crystal display panel.

SUMMARY OF THE INVENTION

In view of this, this disclosure provides a display device and a driving method of the display device. By displaying the same pre-display image in continuous m frame display cycles and setting the drive voltage of the blue sub-pixel on the display panel to be higher than a predetermined grayscale voltage corresponding to the blue sub-pixel in at least one frame display cycle of the m frame display cycles; and setting the drive voltage of the blue sub-pixel at the same position on the display panel to be lower than the predetermined grayscale voltage corresponding to the blue sub-pixel in at least one frame display cycle of the m frame display cycles, the deflection directions of the liquid crystal molecules corresponding to the blue sub-pixel at the same position on the display panel change in the m frame display cycles according to the property that the human eyes are less sensitive to the blue resolution. Thus, the problem that the metal trace and the thin film transistor element affect the transmission rate of the display panel in the existing technology is solved while the color shift problem of the liquid crystal display panel in the condition of the large viewing angle is improved.

The embodiment of this disclosure provides a driving method of the display device. The driving method comprises the following steps. Acquiring a pre-display image, wherein each of sub-pixels in the pre-display image corresponds to a predetermined grayscale voltage. Displaying the same pre-display image in continuous m frame display cycles. In a first frame display cycle of the m frame display cycles, a drive voltage of a blue sub-pixel on a display panel is higher than the predetermined grayscale voltage corresponding to the blue sub-pixel. In a second frame display cycle of the m frame display cycles, the drive voltage of the blue sub-pixel at a same position on the display panel is lower than the predetermined grayscale voltage corresponding to the blue sub-pixel. Wherein m is an integer greater than 1.

The embodiment of this disclosure also provides a display device. The display device comprises an image acquiring module, a drive module, a control module and a display panel. The image acquiring module is configured to acquire a pre-display image, wherein each sub-pixel in the pre-display image corresponds to a predetermined grayscale voltage. The drive module is electrically connected to the image acquiring module, wherein the drive module is configured to drive the display panel to display the same pre-display image in continuous m frame display cycles. In the first frame display cycle of the m frame display cycles, the control module is configured to control a drive voltage of a blue sub-pixel on the display panel to be higher than the predetermined grayscale voltage corresponding to the blue sub-pixel; in the second frame display cycle of the m frame display cycles, the control module is configured to control the drive voltage of the blue sub-pixel at the same position on the display panel to be lower than the predetermined grayscale voltage corresponding to the blue sub-pixel, wherein m is an integer greater than 1. The display panel is electrically connected to the drive module and the control module, respectively.

The embodiment of this disclosure also provides a driving method of the display device. The driving method comprises the following steps. Acquiring a pre-display image, wherein each of sub-pixels in the pre-display image corresponds to a predetermined grayscale voltage. Displaying the same pre-display image in continuous m frame display cycles. The m frame display cycles comprise a p frame first display cycle and a q frame second display cycle. In the p frame first display cycles, the drive voltage of the blue sub-pixel on the display panel is higher than the predetermined grayscale voltage corresponding to the blue sub-pixel; in the q frame second display cycles, the drive voltage of the blue sub-pixel at a same position on the display panel is lower than the predetermined grayscale voltage corresponding to the blue sub-pixel; and wherein $p+q=m$, p is smaller than q, and p and q are positive integers.

BRIEF DESCRIPTION OF THE DRAWINGS

The accompanying drawings are included to provide a further understanding of embodiments of the present disclosure, which constitutes a part of the specification, illustrate embodiments of the present disclosure is used, together and explain the principles of the present disclosure with the description. Apparently, the drawings in the following description are only some embodiments of the present disclosure, those of ordinary skill in the art is concerned, without any creative effort, and may also obtain other drawings based on these drawings. In the drawings.

DETAILED DESCRIPTION OF THE INVENTION

Specific structures and function details disclosed herein are only for the illustrative purpose for describing the exemplary embodiment of this disclosure. However, this disclosure can be specifically implemented through many replacements, and should not be explained as being restricted to only the embodiment disclosed herein.

Figure 1:
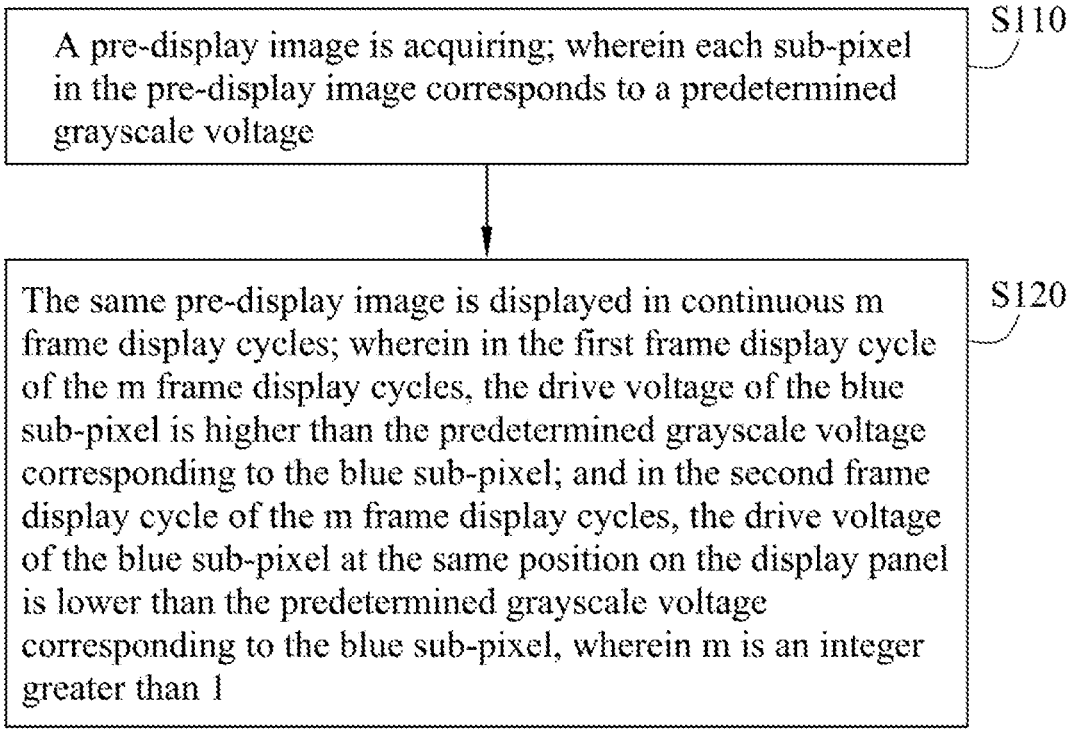
FIG. 1 is a schematic flow chart showing a driving method of a display device provided by the embodiment of this disclosure.

FIG. 1 is a schematic flow chart showing a driving method of a display device provided by the embodiment of this disclosure. The driving method includes steps S110 and S120.

In the step S110, a pre-display image is acquiring. Each sub-pixel in the pre-display image corresponds to a predetermined grayscale voltage.

Optionally, the pre-display image includes multiple sub-pixels. For the pre-display image, each sub-pixel corresponds to a predetermined grayscale value according to the position of the pre-display image where the sub-pixel is located to form the pre-display image.

In the step S120, the same pre-display image is displayed in continuous m frame display cycles. In the first frame display cycle of the m frame display cycles, the drive voltage of the blue sub-pixel is higher than the predetermined grayscale voltage corresponding to the blue sub-pixel; and in the second frame display cycle of the m frame display cycles, the drive voltage of the blue sub-pixel at the same position on the display panel is lower than the predetermined grayscale voltage corresponding to the blue sub-pixel, wherein m is an integer greater than 1.

Figure 2:
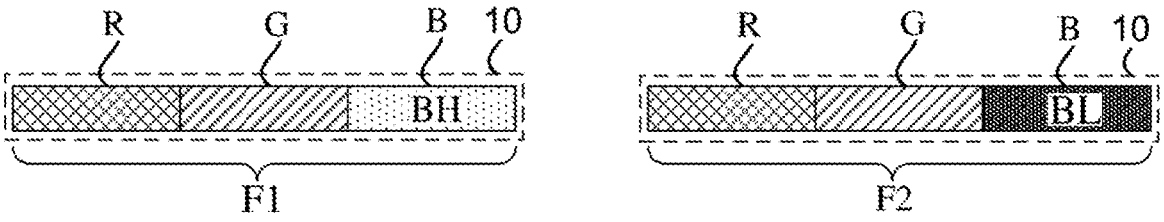
FIG. 2 is a schematic structure view showing the pixel of the display panel at the same position in two frame display cycles provided by the embodiment of this disclosure.

Exemplarily, it is possible to set m to be equal to 2, so that one pre-display image may be displayed through continuous two frame display cycles. FIG. 2 is a schematic structure view showing the pixel of the display panel at the same position in two frame display cycles provided by the embodiment of this disclosure. Referring to FIG. 2, each pixel 10 on the display panel may include three sub-pixels. Exemplarily, the three sub-pixels in each pixel 10 may be respectively a red sub-pixel R, a blue sub-pixel B and a green sub-pixel G. In continuous two frame display cycles, in the first frame display cycle F1, the drive voltage of the blue sub-pixel B at a certain position on the display panel is higher than the predetermined grayscale voltage corresponding to the blue sub-pixel B (BH denotes the drive voltage of the blue sub-pixel B at this time); and in the second frame display cycle F2, the drive voltage of the blue sub-pixel B at the same position of the display panel is lower than the predetermined grayscale voltage corresponding to the blue sub-pixel B (BL denotes the drive voltage of the blue sub-pixel B at this time). Similarly, it is also possible to set the drive voltage of the blue sub-pixel B at a certain position on the display panel to be lower than the predetermined grayscale voltage corresponding to the blue sub-pixel B in the first frame display cycle F1, and to set the drive voltage of the blue sub-pixel B at the same position of the display panel to be higher than the predetermined grayscale voltage corresponding to the blue sub-pixel B in the second frame display cycle F2. That is, in the continuous two frame display cycles, the differences between the drive voltages of the blue sub-pixel B at the same position of the display panel and the predetermined grayscale voltages corresponding to the blue sub-pixel B have different polarities. According to the property that the human eyes are less sensitive to the blue resolution, the deflection directions of the liquid crystal molecules corresponding to the blue sub-pixel B at the same position on the display panel in continuous two frame display cycles change, thereby improving the color shift problem of the liquid crystal display panel in the condition of the large viewing angle. The optical wavelength outputted from the blue sub-pixel B ranges from 400 nm to 480 nm.

Exemplarily, it is possible to set the blue sub-pixel B of FIG. 2 as corresponding to the predetermined grayscale value a, the blue sub-pixel B on the display panel as corresponding to the actual grayscale value b in the first frame display cycle F1, and the blue sub-pixel B on the display panel as corresponding to the actual grayscale value c in the second frame display cycle F2, where b is greater than a and a is greater than c. Optionally, in continuous two frame display cycles, the blue sub-pixels B at the same position of the display panel have different brightness and darkness values.

It is to be noted that the embodiment of this disclosure does not restrict the predetermined grayscale voltage corresponding to the blue sub-pixel in the display panel, and the predetermined grayscale voltage corresponding to the blue sub-pixel may be set according to product's actual design requirement. Meanwhile, FIG. 2 only exemplarily shows the same pre-display image using continuous two frame display cycles, and it is also possible to use more continuous frame display cycles to display the same pre-display image, so the embodiment of this disclosure is not restricted thereto.

Optionally, the m frame display cycles may include a first setting time and a second setting time. In the first setting time, the drive voltage of the blue sub-pixel on the display panel is higher than the predetermined grayscale voltage corresponding to the blue sub-pixel; and in the second setting time, the drive voltage of the blue sub-pixel at the same position on the display panel is lower than the predetermined grayscale voltage corresponding to the blue sub-pixel, and the first setting time is shorter than the second setting time, wherein m is an integer greater than 2.

Optionally, it is possible to set the drive voltage of the blue sub-pixel on the display panel to be higher than the predetermined grayscale voltage corresponding to the blue sub-pixel in p frame display cycles; and to set the drive voltage of the blue sub-pixel at the same position on the display panel to be lower than the predetermined grayscale voltage corresponding to the blue sub-pixel in q frame display cycles; wherein p+q=m, p is smaller than q, and p and q are positive integers.

Figure 3:
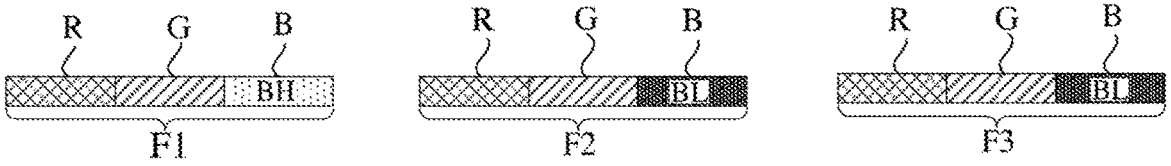
FIG. 3 is a schematic structure view showing the pixel of the display panel at the same position in three frame display cycles provided by the embodiment of this disclosure.

Exemplarily, it is possible to set m to be equal to 3. That is, the same pre-display image is displayed using continuous three frame display cycles. FIG. 3 is a schematic structure view showing the pixel of the display panel at the same position in three frame display cycles provided by the embodiment of this disclosure. As shown in FIG. 3, in the display time corresponding to the continuous three frame display cycles, it is possible to set the time, when the drive voltage of the blue sub-pixel B at the same position of the display panel is lower than the predetermined grayscale voltage corresponding to the blue sub-pixel B, to be longer than the time, when the drive voltage of the blue sub-pixel B is higher than the predetermined grayscale voltage corresponding to the blue sub-pixel B. Optionally, referring to FIG. 3, in the display time corresponding to the continuous three frame display cycles, it is possible to set the drive voltage of the blue sub-pixel B at a certain position of the display panel to be higher than the predetermined grayscale voltage corresponding to the blue sub-pixel B in the first frame display cycle F1; and to set the drive voltage of the blue sub-pixel B at the same position of the display panel to be lower than the predetermined grayscale voltages corresponding to the blue sub-pixels B in the second frame display cycle F2 and the third frame display cycle F3. That is, in two frame display cycles of the continuous three frame display cycles, the drive voltage of the blue sub-pixel B at the same position of the display panel is lower than the predetermined grayscale voltage corresponding to the voltage of the blue sub-pixel B; and in one frame display cycle of the continuous three frame display cycles, the drive voltage of the blue sub-pixel B is higher than the predetermined grayscale voltage corresponding to the blue sub-pixel B. Meanwhile, it is possible to set the display time in each frame display cycle to be the same. Taking the time of each frame display cycle equal to 1 ms as an example, in the three successive frame display cycles of 3 ms, the time (i.e., the first setting time), when the drive voltage of the blue sub-pixel B at the same position of the display panel is higher than the predetermined grayscale voltage corresponding to the voltage of the blue sub-pixel B, is 1 ms; and the time (i.e., the second setting time), when the drive voltage of the blue sub-pixel B at the same position of the display panel is lower than the predetermined grayscale voltage corresponding to the voltage of the blue sub-pixel B, is 2 ms, where the first setting time is shorter than the second setting time.

In continuous m frame display cycles, when the time (i.e., the second setting time), when the drive voltage of the blue sub-pixel B at the same position of the display panel is lower than the predetermined grayscale voltage corresponding to the blue sub-pixel B, is longer than the time (i.e., the first setting time), when the drive voltage of the blue sub-pixel B is higher than the predetermined grayscale voltage corresponding to the blue sub-pixel B, the actual gamma curve corresponding to the blue sub-pixel B is closer to the gamma curve corresponding to the front viewing angle. Thus, by setting the number of frame(s), in which the drive voltage of the blue sub-pixel B at the same position of the display panel is lower than the predetermined grayscale voltage corresponding to the voltage of the blue sub-pixel B, to be greater than the number of frame(s), in which the drive voltage of the blue sub-pixel B is higher than the predetermined grayscale voltage corresponding to the blue sub-pixel B, in the continuous m frame display cycles, it is possible to implement that the time, in which the drive voltage of the blue sub-pixel B at the same position of the display panel is lower than the predetermined grayscale voltage corresponding to the blue sub-pixel B, is longer than the time, when the drive voltage of the blue sub-pixel B is higher than the predetermined grayscale voltage corresponding to the blue sub-pixel B, in m frame display cycles, and to further improve the color shift problem of the liquid crystal display panel in the condition of the large viewing angle.

It is to be noted that FIG. 3 only exemplarily sets the drive voltage of the blue sub-pixel B at the same position of the display panel to be higher than the predetermined grayscale voltage corresponding to the blue sub-pixel B in the first frame display cycle F1, and it is also possible to set the drive voltage of the blue sub-pixel B at the same position of the display panel to be higher than the predetermined grayscale voltage corresponding to the blue sub-pixel B in other frame display cycles, so the embodiment of this disclosure is not restricted thereto.

In the above-mentioned embodiment, the blue sub-pixel B in a certain pixel at the same position of the display panel is utilized through the control of the drive timing to implement the improvement on the color shift problem of the liquid crystal display panel in the condition of the large viewing angle. It is also possible to utilize the blue sub-pixels B of multiple pixels at the same position of the display panel through the control of the drive timing to implement the improvement on the color shift problem of the liquid crystal display panel in the condition of the large viewing angle. In the following example, the blue sub-pixels B of two pixels at the same position of the display panel are described.

Figure 4:
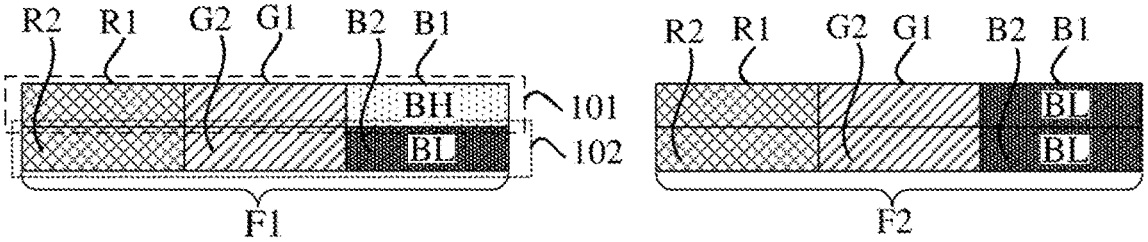
FIG. 4 is a schematic structure view showing the pixel of the display panel at the same position in other two frame display cycles provided by the embodiment of this disclosure.

Exemplarily, FIG. 4 is a schematic structure view showing the pixel of the display panel at the same position in other two frame display cycles provided by the embodiment of this disclosure. Referring to FIG. 4, regarding the pixels 101 and 102, m is equal to 2 in this example. In continuous two frame display cycles, the drive voltage of the blue sub-pixel B1 in the pixel 101 on the display panel is higher than the predetermined grayscale voltage corresponding to the blue sub-pixel B1 in the first frame display cycle F1; the drive voltage of the blue sub-pixel B2 in the pixel 102 on the display panel in the first frame display cycle F1 and the drive voltage of the blue sub-pixel B2 in the pixel 102 on the display panel in the second frame display cycle F2 are lower than the predetermined grayscale voltage corresponding to the blue sub-pixel B2; and the drive voltage of the blue sub-pixel B1 in the pixel 101 on the display panel in the second frame display cycle F2 is lower than the predetermined grayscale voltage corresponding to the blue sub-pixel B1. In this manner, the temporary effect ratio of the blue sub-pixel B at the high drive voltage to the blue sub-pixel B at the low drive voltage in the human eyes in two frame display cycles reaches 1:3, thereby improving the color shift problem of the liquid crystal display panel in the condition of the large viewing angle. Those skilled in the art will be appreciated that it is further possible to set the temporary effect ratio of the blue sub-pixel B at the high drive voltage to the blue sub-pixel B at the low drive voltage in the human eyes in two frame display cycles to be 1:1 (2:2).

Figure 5:
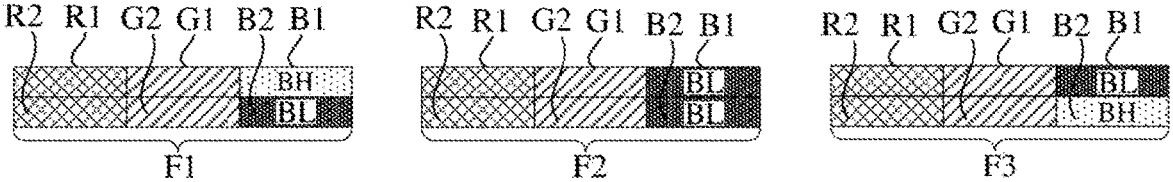
FIG. 5 is a schematic structure view showing the pixel of the display panel at the same position in other three frame display cycles provided by the embodiment of this disclosure.

Exemplarily, it is also possible to adopt the pixel structure of the display panel at the same position in the three frame display cycles of FIG. 5. That is, the blue sub-pixels B1 and B2 in two pixels at the same position of the display panel is utilized, and m is set to be equal to 3. Referring to FIG. 5, the temporary effect ratio of the blue sub-pixel B at the high drive voltage to the blue sub-pixel B at the low drive voltage in the human eyes in continuous three frame display cycles may reach 1:2 (2:4). Those skilled in the art will be appreciated that it is further possible to set the temporary effect ratio of the blue sub-pixel B at the high drive voltage to the blue sub-pixel B at the low drive voltage in the human eyes in continuous three frame display cycles to be 1:1 (3:3) and 1:5, wherein detailed descriptions thereof will be omitted here.

Figure 6:
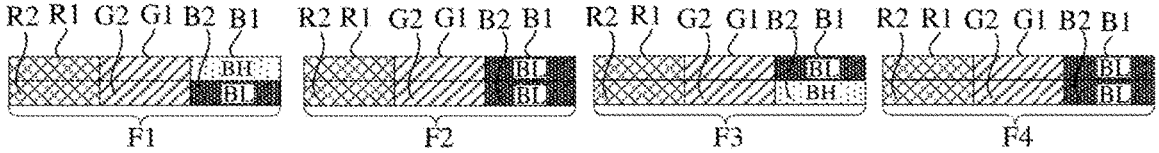
FIG. 6 is a schematic structure view showing the pixel of the display panel at the same position in four frame display cycles provided by the embodiment of this disclosure.
Figure 7:
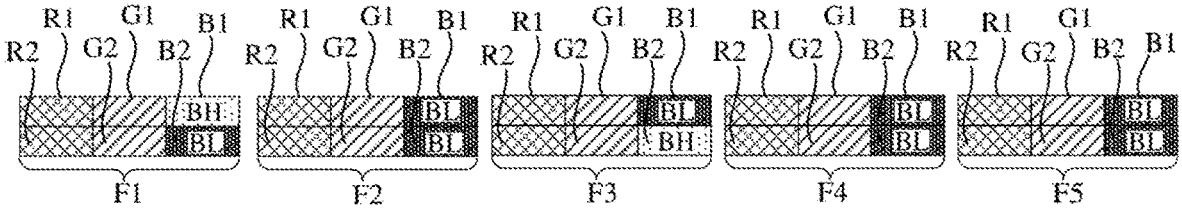
FIG. 7 is a schematic structure view showing the pixel of the display panel at the same position in five frame display cycles provided by the embodiment of this disclosure.

Exemplarily, when the blue sub-pixels B1 and B2 in two pixels at the same position of the display panel are utilized and m is set to be equal to 4, as shown in FIG. 6, the temporary effect ratio of the blue sub-pixel B at the high drive voltage to the blue sub-pixel B at the low drive voltage in the human eyes in the continuous four frame display cycles reaches 1:3 (2:6), wherein the ratio may further be changed to 1:1 (4:4), 1:7 or 3:5. When m is set to be equal to 5, as shown in FIG. 7, the temporary effect ratio of the blue sub-pixel B at the high drive voltage to the blue sub-pixel B at the low drive voltage in the human eyes in the continuous five frame display cycles reaches 1:4 (2:8), wherein the ratio may further be changed to 1:1 (5:5), 2:3 (4:6), 3:7 or 1:9.

It is to be noted that FIGS. 4 to 7 are exemplarily described only according to the adjacent pixels in the column direction of the pixel array, wherein the adjacent pixels may also be two pixels in the row direction of the pixel array. The two pixels may abut upon each other, and may also not abut upon each other, the embodiment of this disclosure is not restricted thereto. Using the adjacent pixels in the column direction of the pixel array can guarantee the resolution of the liquid crystal display panel at the highest degree.

Figure 8:
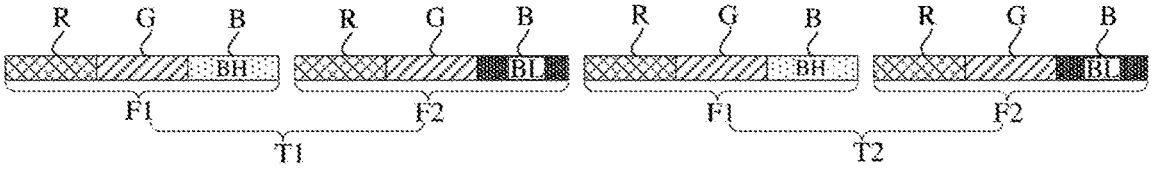
FIG. 8 is a schematic structure view showing the pixel of the display panel at the same position in two drive cycles provided by the embodiment of this disclosure.

Optionally, the continuous m frame display cycles constitute a drive cycle. The drive timings of the m frame display cycles in the adjacent two drive cycles may be the same. Taking m equal to 2 as an example and referring to FIG. 8, it is possible to set the drive timings of the two frame display cycles in adjacent two drive cycles to be the same. That is, it is possible to set the drive voltage of the blue sub-pixel B at the same position of the display panel to be higher than the predetermined grayscale voltage corresponding to the blue sub-pixel B in the first frame display cycle F1 of the first drive cycle T1, and to set the drive voltage of the blue sub-pixel B at the same position of the display panel to be lower than the predetermined grayscale voltage corresponding to the blue sub-pixel B in the second frame display cycle F2 of the first drive cycle T1. Correspondingly, it is possible to set the drive voltage of the blue sub-pixel B at the same position of the display panel to be higher than the predetermined grayscale voltage corresponding to the blue sub-pixel B in the first frame display cycle F1 of the second drive cycle T2, and to set the drive voltage of the blue sub-pixel B at the same position of the display panel to be lower than the predetermined grayscale voltage corresponding to the blue sub-pixel B in the second frame display cycle F2 of the second drive cycle T2.

Figure 9:
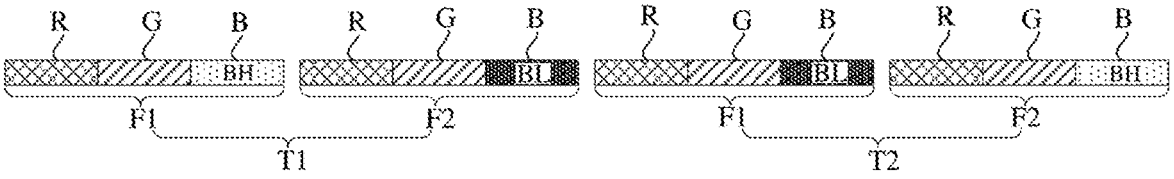
FIG. 9 is a schematic structure view showing the pixel of the display panel at the same position in other two drive cycles provided by the embodiment of this disclosure.

Optionally, the continuous m frame display cycles constitute a drive cycle. The drive timings of the m frame display cycles in the adjacent two drive cycles may be different. Taking m equal to 2 as an example and referring to FIG. 9, it is possible to set the drive timings of the two frame display cycles in adjacent two drive cycles to be different from each other. That is, it is possible to set the drive voltage of the blue sub-pixel B at the same position of the display panel to be higher than the predetermined grayscale voltage corresponding to the blue sub-pixel B in the first frame display cycle F1 of the first drive cycle T1, and to set the drive voltage of the blue sub-pixel B at the same position of the display panel to be lower than the predetermined grayscale voltage corresponding to the blue sub-pixel B in the second frame display cycle F2 of the first drive cycle T1. Correspondingly, it is possible to set the drive voltage of the blue sub-pixel B at the same position of the display panel to be lower than the predetermined grayscale voltage corresponding to the blue sub-pixel B in the first frame display cycle F1 of the second drive cycle T2, and to set the drive voltage of the blue sub-pixel B at the same position of the display panel to be higher than the predetermined grayscale voltage corresponding to the blue sub-pixel B in the second frame display cycle F2 of the second drive cycle T2.

Figure 10:
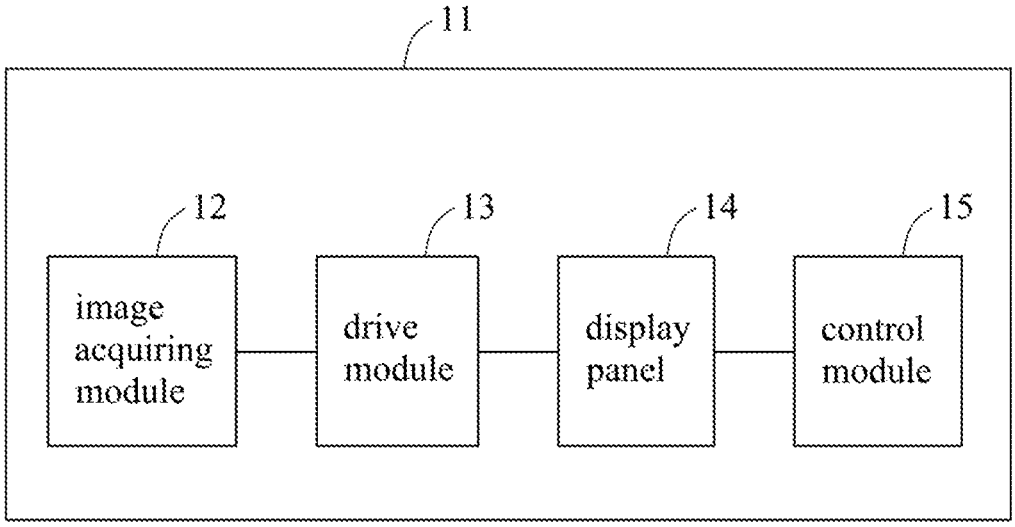
FIG. 10 is a schematic structure view showing a display device provided by the embodiment of this disclosure.

FIG. 10 is a schematic structure view showing a display device provided by the embodiment of this disclosure. Referring to FIG. 10, a display device 11 includes an image acquiring module 12, a drive module 13, a display panel 14 and a control module 15. The drive module 13 is electrically connected to the image acquiring module 12, and the display panel 14 is electrically connected to the drive module 13 and the control module 15. The image acquiring module 12 is configured to acquire the pre-display image. Each sub-pixel in the pre-display image corresponds to a predetermined grayscale voltage. The drive module 13 is configured to drive the display panel to display the same pre-display image in continuous m frame display cycles. in at least one frame display cycle of the m frame display cycles. The control module 15 is configured to control the drive voltage of the blue sub-pixel on the display panel to be higher than the predetermined grayscale voltage corresponding to the blue sub-pixel. In at least one frame display cycle of the m frame display cycles, the control module is configured to control the drive voltage of the blue sub-pixel at the same position on the display panel to be lower than the predetermined grayscale voltage corresponding to the blue sub-pixel, wherein m is an integer greater than 1. The display panel 14 is electrically connected to the control module 15 and the drive module 13, and is configured to display the pre-display image. Exemplarily, the display device 11 in the embodiment of this disclosure may be, for example, a liquid crystal display device.

Optionally, it is further possible to configure the control module to control the drive voltage of the blue sub-pixel on the display panel to be higher than the predetermined grayscale voltage corresponding to the blue sub-pixel in the first setting time; control the drive voltage of the blue sub-pixel at the same position on the display panel is lower than the predetermined grayscale voltage corresponding to the blue sub-pixel in a second setting time; and the m frame display cycles comprise the first setting time and the second setting time; the first setting time is shorter than the second setting time; wherein m is an integer greater than 2.

Optionally, it is further possible to configure the control module to control the drive voltage of the blue sub-pixel on the display panel to be higher than the predetermined grayscale voltage corresponding to the blue sub-pixel in the m frame display cycles; control the drive voltage of the blue sub-pixel at a same position on the display panel to be lower than the predetermined grayscale voltage corresponding to the blue sub-pixel in q frame second display cycles; wherein p+q=m, p is smaller than q, and p and q are positive integers.

Optionally, the continuous m frame display cycles constitute a drive cycle. It is further possible to configure the control module to control the drive timings of the m frame display cycles in the adjacent two drive cycles to be the same as or different from each other.

Figure 11:
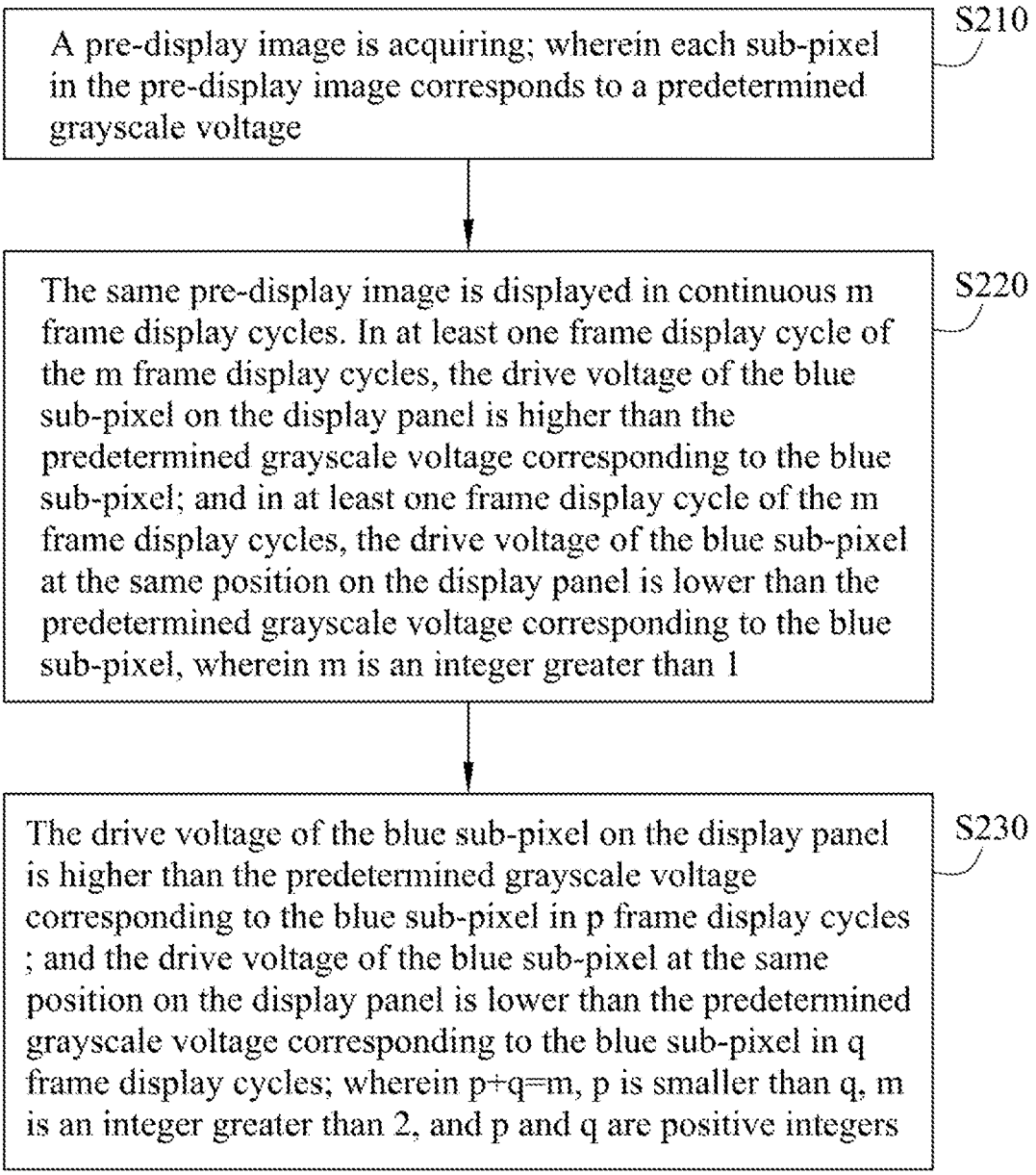
FIG. 11 is a schematic flow chart showing another driving method of a display device provided by the embodiment of this disclosure.

FIG. 11 is a schematic flow chart showing another driving method of a display device provided by the embodiment of this disclosure. The driving method may be applied to the scene where the display device needs to be driven to perform the flat display, and may be executed by the display device provided by the embodiment of this disclosure. The method includes steps S210 to S230.

In the step S210, a pre-display image is acquiring. Each sub-pixel in the pre-display image corresponds to a predetermined grayscale voltage.

In the step S220, the same pre-display image is displayed in continuous m frame display cycles. In at least one frame display cycle of the m frame display cycles, the drive voltage of the blue sub-pixel on the display panel is higher than the predetermined grayscale voltage corresponding to the blue sub-pixel; and in at least one frame display cycle of the m frame display cycles, the drive voltage of the blue sub-pixel at the same position on the display panel is lower than the predetermined grayscale voltage corresponding to the blue sub-pixel, wherein m is an integer greater than 1.

In the step S230, the drive voltage of the blue sub-pixel on the display panel is higher than the predetermined grayscale voltage corresponding to the blue sub-pixel in p frame display cycles; and the drive voltage of the blue sub-pixel at the same position on the display panel is lower than the predetermined grayscale voltage corresponding to the blue sub-pixel in q frame display cycles; wherein p+q=m, p is smaller than q, m is an integer greater than 2, and p and q are positive integers.

The embodiment of this disclosure increases the aperture ratio by displaying the same pre-display image in continuous m frame display cycles and setting the drive voltage of the blue sub-pixel on the display panel to be higher than a predetermined grayscale voltage corresponding to the blue sub-pixel in at least one frame display cycle of the m frame display cycles; and setting the drive voltage of the blue sub-pixel at the same position on the display panel to be lower than the predetermined grayscale voltage corresponding to the blue sub-pixel in at least one frame display cycle of the m frame display cycles, the deflection directions of the liquid crystal molecules corresponding to the blue sub-pixel at the same position on the display panel change in the m frame display cycles according to the property that the human eyes are less sensitive to the blue resolution. Thus, the problem that the color shift problem of the liquid crystal display panel in the condition of the large viewing angle is improved.

Although the disclosure has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the disclosure.

What is claimed is:

1. A driving method of a display device, comprising:

acquiring a pre-display image, wherein each of sub-pixels in the pre-display image corresponds to a predetermined grayscale voltage; and displaying the same pre-display image in continuous m frame display cycles, wherein the continuous m frame display cycles comprise a first frame display cycle and a second frame display cycle; in the first frame display cycle, a drive voltage of a blue sub-pixel on a display panel of the display device is higher than the predetermined grayscale voltage corresponding to the blue sub-pixel; and in the second frame display cycle, the drive voltage of the blue sub-pixel at a same position on the display panel is lower than the predetermined grayscale voltage corresponding to the blue sub-pixel, wherein m is an integer greater than 1.

2. The driving method according to claim 1, wherein the m frame display cycles comprise a first setting time and a second setting time;

in the first setting time, the drive voltage of the blue sub-pixel on the display panel is higher than the predetermined grayscale voltage corresponding to the blue sub-pixel;

in the second setting time, the drive voltage of the blue sub-pixel at the same position on the display panel is lower than the predetermined grayscale voltage corresponding to the blue sub- pixel; and the first setting time is shorter than the second setting time;

wherein m is an integer greater than 2.

3. The driving method according to claim 2, wherein in the first setting time, the drive voltage of the blue sub-pixel on the display panel is higher than the predetermined grayscale voltage corresponding to the blue sub-pixel; and in the second setting time, the drive voltage of the blue sub-pixel at a same position on the display panel is lower than the predetermined grayscale voltage corresponding to the blue sub-pixel comprises:

in p frame first display cycles, the drive voltage of the blue sub-pixel on the display panel is higher than the predetermined grayscale voltage corresponding to the blue sub-pixel; and in q frame second display cycles, the drive voltage of the blue sub-pixel at a same position on the display panel is lower than the predetermined grayscale voltage corresponding to the blue sub-pixel;

wherein p+q=m, p is smaller than q, and p and q are positive integers.

4. The driving method according to claim 3, wherein m is equal to 4, p is equal to 1, and q is equal to 3.

5. The driving method according to claim 1, wherein continuous m frame display cycles constitute a drive cycle, and drive timings of m frame display cycles in adjacent two of the drive cycles are the same.

6. The driving method according to claim 1, wherein continuous m frame display cycles constitute a drive cycle, and drive timings of m frame display cycles in adjacent two of the drive cycles are different.

7. The driving method according to claim 1, wherein an optical wavelength outputted from the blue sub-pixel is longer than or equal to 400 nm, and shorter than or equal to 480 nm.

8. The driving method according to claim 1, wherein the display panel of the display device further comprises a red sub-pixel and a green sub-pixel.

9. The driving method according to claim 1, wherein m is equal to 2, the continuous m frame display cycles are composed of the first frame display cycle and the second frame display cycle.

10. The driving method according to claim 9, wherein a grayscale value corresponding to the blue sub-pixel in the first frame display cycle is greater than a predetermined grayscale value corresponding to the blue sub-pixel, and the predetermined grayscale value corresponding to the blue sub-pixel is greater than a grayscale value corresponding to the blue sub-pixel in the second frame display cycle.

11. A driving method of a display device, comprising:

acquiring a pre-display image, wherein each of sub-pixels in the pre-display image corresponds to a predetermined grayscale voltage;

displaying the same pre-display image in continuous m frame display cycles;

wherein the m frame display cycles comprise a p frame first frame display cycle and a q frame second frame display cycle;

in the p frame first display cycles, the drive voltage of the blue sub-pixel on the display panel is higher than the predetermined grayscale voltage corresponding to the blue sub-pixel;

in the q frame second display cycles, the drive voltage of the blue sub-pixel at a same position on the display panel is lower than the predetermined grayscale voltage corresponding to the blue sub-pixel; and wherein $p+q=m$, p is smaller than q, and p and q are positive integers.

12. The driving method according to claim 11, wherein m is equal to 4, p is equal to 1, and q is equal to 3.

* * * * *